US011727794B2

(12) United States Patent
Bielby

(10) Patent No.: US 11,727,794 B2
(45) Date of Patent: Aug. 15, 2023

(54) SYSTEMS AND METHODS FOR EVALUATING AND SHARING HUMAN DRIVING STYLE INFORMATION WITH PROXIMATE VEHICLES

(71) Applicant: Micron Technology, Inc., Boise, ID (US)

(72) Inventor: Robert Richard Noel Bielby, Placerville, CA (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 15/921,472

(22) Filed: Mar. 14, 2018

(65) Prior Publication Data

US 2019/0287392 A1 Sep. 19, 2019

(51) Int. Cl.

| | |
|---|---|
| ***G08G 1/01*** | (2006.01) |
| ***G08G 1/0967*** | (2006.01) |
| ***G08G 1/052*** | (2006.01) |
| ***G08G 1/017*** | (2006.01) |

(52) U.S. Cl.

CPC ..... *G08G 1/0133* (2013.01); *G08G 1/017* (2013.01); *G08G 1/0112* (2013.01); *G08G 1/052* (2013.01); *G08G 1/096766* (2013.01)

(58) Field of Classification Search

CPC ..... G08G 1/0133; G08G 1/017; G08G 1/052; G08G 1/0112; G08G 1/096766; G08G 1/0129; G08G 1/096775; G08G 1/096741; G08G 1/096791; G08G 1/00–99/00; B60W 10/00–2900/00;

(Continued)

(56) References Cited

U.S. PATENT DOCUMENTS

| | | | | |
|---|---|---|---|---|
| 6,023,653 | A | 2/2000 | Ichimura et al. | |
| 8,185,296 | B2 * | 5/2012 | Yokoyama ..... | B60W 30/16 701/117 |
| 8,442,791 | B2 | 5/2013 | Stahlin | |

(Continued)

OTHER PUBLICATIONS

International Search Report and Written Opinion, PCT/US2019/025112, dated Jul. 19, 2019.

(Continued)

*Primary Examiner* — Fadey S. Jabr
*Assistant Examiner* — Mohamed Abdo Algehaim
(74) *Attorney, Agent, or Firm* — Greenberg Traurig

(57) ABSTRACT

Systems and methods for characterizing a driving style of a human driver are presented. A system may include one or more sensors configured to collect information concerning driving characteristics associated with operation of a vehicle by a human; a memory containing computer-readable instructions for evaluating the information concerning driving characteristics collected by the one or more sensors for one or more patterns correlatable with a driving style of the human and for characterizing aspects of the driving style of the human based on the one or more patterns; and a processor configured to read the computer-readable instructions from the memory, evaluate the driving characteristics collected by the one or more sensors for one or more patterns correlatable with a driving style of the human, and characterize aspects of the driving style of the human based on the one or more patterns. Corresponding methods and non-transitory media are disclosed.

20 Claims, 10 Drawing Sheets

(58) Field of Classification Search
CPC ..... G06Q 10/00–2250/905; G05D 1/00–1/12; G06N 3/00–99/007
USPC ..... 701/119
See application file for complete search history.

(56) References Cited

U.S. PATENT DOCUMENTS 8,543,320 B2 9/2013 Zheng et al.
8,688,369 B2 4/2014 Denaro
8,825,371 B2 9/2014 Prokhorov et al.
9,043,127 B2 5/2015 Denaro
9,062,977 B2 6/2015 Prokhorov et al.
9,221,461 B2 12/2015 Ferguson et al.
9,279,688 B2 3/2016 Denaro
9,296,299 B2 * 3/2016 Ricci ..... G06F 3/0484
9,754,501 B2 * 9/2017 Stenneth ..... G07C 5/008
9,786,172 B2 10/2017 Takahara et al.
9,797,735 B2 10/2017 Denaro
9,805,601 B1 10/2017 Fields et al.
9,961,551 B2 5/2018 Scholl et al.
10,031,523 B2 * 7/2018 Ricci ..... B60R 25/24
10,049,328 B2 * 8/2018 Jiang ..... G05D 1/0088
10,068,477 B2 9/2018 Miller et al.
10,099,697 B2 10/2018 Tatourian et al.
10,139,831 B2 11/2018 Yan
10,163,274 B1 * 12/2018 Brinkmann ..... G01S 19/01
10,179,586 B2 1/2019 Johnson
10,215,571 B2 2/2019 Ghadiok et al.
10,223,380 B2 3/2019 Giurgiu et al.
10,257,270 B2 * 4/2019 Cohn ..... H04L 67/1068
10,269,242 B2 4/2019 Ahmad et al.
10,298,741 B2 5/2019 Goren et al.
10,311,728 B2 6/2019 Stenneth et al.
10,331,141 B2 6/2019 Grimm et al.
10,345,110 B2 7/2019 Westover et al.
10,460,394 B2 10/2019 Perl et al.
10,493,994 B1 * 12/2019 Fields ..... H04W 4/40
10,518,720 B2 12/2019 Haque
10,529,231 B2 1/2020 Scofield
10,543,853 B2 1/2020 Toyoda et al.
10,648,818 B2 5/2020 Denaro
10,755,111 B2 8/2020 Golov et al.
10,997,429 B2 5/2021 Golov
11,004,339 B2 5/2021 Oe et al.
11,009,876 B2 5/2021 Bielby
11,072,343 B2 7/2021 Emura et al.
11,161,518 B2 11/2021 Golov
11,441,916 B1 * 9/2022 Konrardy ..... H04W 4/40
2005/0232469 A1 10/2005 Schofield et al.
2008/0189040 A1 * 8/2008 Nasu ..... G08G 1/163 701/301
2009/0234552 A1 * 9/2009 Takeda ..... G08G 1/167 701/1
2009/0265070 A1 10/2009 Okada et al.
2010/0099353 A1 4/2010 Komori
2011/0153532 A1 * 6/2011 Kuge ..... B60W 50/14 706/12
2011/0302214 A1 12/2011 Frye et al.
2012/0109517 A1 5/2012 Watanabe
2012/0296560 A1 * 11/2012 Zheng ..... G08G 1/0129 701/119
2013/0054049 A1 * 2/2013 Uno ..... G08G 1/164 701/1
2014/0067187 A1 3/2014 Ferguson et al.
2014/0172290 A1 6/2014 Prokhorov et al.
2015/0039365 A1 * 2/2015 Haque ..... G06Q 10/06311 705/7.13
2015/0057838 A1 * 2/2015 Scholl ..... H04W 12/08 701/2
2016/0150070 A1 * 5/2016 Goren ..... H04W 4/029 455/404.2
2016/0176440 A1 6/2016 Witte et al.
2016/0209841 A1 7/2016 Yamaoka et al.
2016/0229404 A1 8/2016 Byun
2016/0280224 A1 * 9/2016 Tatourian ..... B60W 30/143
2016/0351050 A1 12/2016 Takahara et al.
2016/0363935 A1 * 12/2016 Shuster ..... B60L 7/10
2017/0015318 A1 * 1/2017 Scofield ..... G08G 1/0112
2017/0039890 A1 * 2/2017 Truong ..... G07C 5/02
2017/0217433 A1 8/2017 Halder et al.
2017/0232974 A1 8/2017 Nishida
2017/0277716 A1 9/2017 Giurgiu et al.
2017/0310747 A1 10/2017 Cohn et al.
2017/0316691 A1 11/2017 Miller et al.
2017/0323179 A1 11/2017 Vallespi-gonzalez
2017/0372431 A1 * 12/2017 Perl ..... G07C 5/085
2018/0004223 A1 1/2018 Baldwin
2018/0018869 A1 1/2018 Ahmad et al.
2018/0038698 A1 2/2018 Denaro
2018/0045519 A1 2/2018 Ghadiok et al.
2018/0047285 A1 * 2/2018 Johnson ..... B60W 50/14
2018/0050800 A1 2/2018 Boykin et al.
2018/0093676 A1 * 4/2018 Emura ..... G05D 1/0257
2018/0105186 A1 * 4/2018 Motomura ..... G06V 10/82
2018/0107942 A1 * 4/2018 Jiang ..... G08G 1/096725
2018/0238702 A1 * 8/2018 Liebinger ..... G01C 21/3461
2018/0259968 A1 9/2018 Frazzoli et al.
2018/0293466 A1 10/2018 Viswanathan
2018/0335785 A1 * 11/2018 Miller ..... B60W 50/0098
2019/0009794 A1 * 1/2019 Toyoda ..... B60W 50/085
2019/0047584 A1 * 2/2019 Donnelly ..... B60W 30/025
2019/0049257 A1 * 2/2019 Westover ..... G01C 21/3453
2019/0049262 A1 * 2/2019 Grimm ..... G07C 5/008
2019/0051172 A1 * 2/2019 Stenneth ..... G08G 1/0112
2019/0064843 A1 * 2/2019 Matsui ..... G05D 1/0274
2019/0077413 A1 * 3/2019 Kondo ..... B60W 50/0098
2019/0088135 A1 * 3/2019 Do ..... G08G 1/096725
2019/0108752 A1 * 4/2019 Oe ..... G08G 1/0129
2019/0147252 A1 5/2019 Sawada et al.
2019/0168772 A1 * 6/2019 Emura ..... G06V 40/172
2019/0170519 A1 6/2019 Anwar et al.
2019/0196481 A1 6/2019 Tay et al.
2019/0236379 A1 8/2019 Golov et al.
2019/0271550 A1 * 9/2019 Breed ..... G08G 1/147
2019/0286133 A1 9/2019 Bielby
2019/0300017 A1 10/2019 Glaser et al.
2019/0316913 A1 10/2019 Golov
2019/0382004 A1 12/2019 Golov
2019/0382029 A1 12/2019 Golov
2020/0023839 A1 * 1/2020 Yan ..... B60W 30/18163
2020/0039508 A1 2/2020 Onishi
2020/0135021 A1 * 4/2020 Akachi ..... B60N 2/90
2020/0202560 A1 6/2020 Viswanathan
2020/0387722 A1 12/2020 Golov et al.
2021/0070286 A1 * 3/2021 Green ..... B60W 30/0956
2021/0216790 A1 7/2021 Golov
2021/0271243 A1 9/2021 Bielby
2022/0024469 A1 1/2022 Golov

OTHER PUBLICATIONS

Zhang, Xiaoyu, "The research of traffic information collection system based on crowdsourcing and related privacy ssues", master's thesis, May 28, 2016, Jilin University, Changchun, China.

* cited by examiner

SYSTEMS AND METHODS FOR EVALUATING AND SHARING HUMAN DRIVING STYLE INFORMATION WITH PROXIMATE VEHICLES

BACKGROUND

Driving styles vary from human driver to human driver, with some drivers having more dangerous or frustrating driving styles characterized by tendencies to be too aggressive, too passive, or to drive while distracted, amongst others. These variations in human driving style can be difficult to predict by nearby drivers or by the sensing and control systems of nearby autonomous vehicles, often leading to close calls and accidents, as well as unpleasant rider experiences due to frustration with the drivers of nearby vehicles. Therefore, there is a need for improved ways for assessing the driving style of nearby human drivers in order to improve safety and the driving experience.

SUMMARY

The present disclosure is directed to a system for characterizing a driving style of a human driver. The system, in various embodiments, may comprise one or more sensors configured to collect information concerning driving characteristics associated with operation of a vehicle by a human; a memory containing computer-readable instructions for evaluating the information concerning driving characteristics collected by the one or more sensors for one or more patterns correlatable with a driving style of the human and for characterizing aspects of the driving style of the human based on the one or more patterns; and a processor configured to: read the computer-readable instructions from the memory, evaluate the driving characteristics collected by the one or more sensors for one or more patterns correlatable with a driving style of the human, and characterize aspects of the driving style of the human based on the one or more patterns.

The information concerning driving characteristics, in various embodiments may include identifiable metrics regarding how the human operates the vehicle. Representative examples may include without limitation one or a combination of vehicle speed, vehicle acceleration, vehicle location, braking force, braking deceleration, vehicle speed relative to speed limit, vehicle speed in construction zones, vehicle speed in school zones, lane departures, relative speed to a vehicle driving ahead, relative distance to a vehicle driving ahead, and relative acceleration to a vehicle driving ahead.

The aspects of the driving style of the human, in various embodiments, may include one or more patterns or tendencies derived from the collected driving characteristics. Representative examples may include without limitation one or a combination of rapid acceleration and braking, following closely, dangerously changing lanes or changing lanes without signaling, drifting out of a traffic lane, exceeding the speed limit, driving well under the speed limit, accelerating very slowly from stops, late braking, a number, severity, and timing of traffic accidents, and a number, severity, and timing of traffic violations.

The processor, in various embodiments, may be located onboard the vehicle driven by the driver. In some embodiments, the system may further include a transmitter on the vehicle driven by the human driver for transmitting the aspects of the driving style of the human to a nearby vehicle or to a remote server. In an embodiment, the driving style is transmitted to a remote server and the remote server may transmit the driving style to a nearby vehicle.

The processor, in various other embodiments, may be located on a nearby vehicle. In an embodiment, the system may further include a transmitter on the vehicle driven by the human driver for transmitting the information concerning driving characteristics to the processor located on the nearby vehicle.

The processor, in still further embodiments, may be located at a remote server. In some embodiments, the system may further include a transmitter on the vehicle driven by the human driver for transmitting the information concerning driving characteristics to the processor located at the remote server. The processor at the remote server, in an embodiment, may evaluate the driving characteristics for the one or more patterns and characterize aspects of the driving style of the human driver. The remote server, in an embodiment, may be configured to transmit the aspects of the driving style of the human to a nearby vehicle.

In various embodiments, the processor may be further configured to automatically generate a warning communicable to a human operating the nearby vehicle based on a preferred driving experience of the human operating the nearby vehicle. Additionally or alternatively, the processor, in various embodiments, may be further configured to automatically identify one or more options for adjusting an operation of the nearby autonomous vehicle based on a preferred driving experience of an occupant of the nearby autonomous vehicle.

In another aspect, the present disclosure is directed to a method for characterizing a driving style of a human driver. The method, in various embodiments, may comprise collecting information concerning driving characteristics associated with operation of a vehicle by a human; evaluating the information concerning driving characteristics for one or more patterns correlatable with a driving style of the human; and characterizing aspects of the driving style of the human based on the one or more patterns.

In various embodiments, the steps of evaluating and characterizing may be performed onboard or offboard the vehicle. In some offboard embodiments, the method may include sharing, with a nearby vehicle or remote server, the information concerning driving characteristics associated with operation of the vehicle by the human.

The method, in various embodiments, may further include automatically generating a warning communicable to a human operating a nearby vehicle based on a preferred driving experience of the human operating the nearby vehicle. In various embodiments involving nearby autonomous vehicles, the method may further include automatically identifying one or more options for adjusting an operation of a nearby autonomous vehicle based on a preferred driving experience of an occupant of the nearby autonomous vehicle.

In yet another aspect, the present disclosure is directed to a non-transitory machine readable medium storing instructions that, when executed on a computing device, cause the computing device to perform a method for characterizing a driving style of a human driver. The method performed by the computing device, in various embodiments, may comprise collecting information concerning driving characteristics associated with operation of a vehicle by a human; evaluating the driving characteristics for one or more patterns correlatable with a driving style of the human; and characterizing aspects of the driving style of the human based on the one or more patterns.

DETAILED DESCRIPTION

Figure 1:
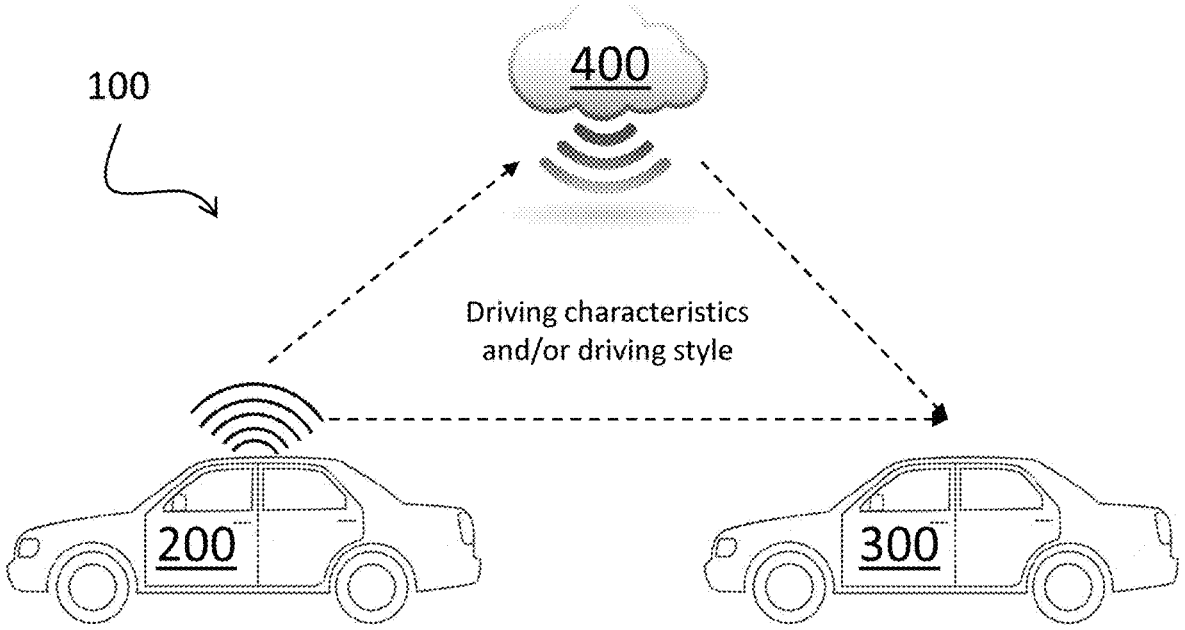
FIG. 1 schematically depicts a representative system for collecting, evaluating, and sharing information concerning the driving style of a human driver with nearby vehicles, according to an embodiment of the present disclosure.

Embodiments of the present disclosure include systems and methods for characterizing aspects of the driving style of a human driver and sharing that information with surrounding vehicles to improve safety and enhance the driving experience. In particular, the present systems and methods may be configured to evaluate characteristics of how a particular human is currently driving and/or has driven in the recent past in order to identify patterns and other relevant information indicative of aspects of that particular driver's driving style. Driving style information can be shared with surrounding autonomous and/or human-piloted vehicles for consideration by their respective autonomous control systems and human drivers. By better understanding the driving style of a nearby human driver, autonomous vehicles and nearby human drivers can take action to improve safety and enhance the driving experience, as later described in more detail.

Within the scope of the present disclosure, the term "autonomous vehicle" and derivatives thereof generally refer to vehicles such as cars, trucks, motorcycles, aircraft, and watercraft that are piloted by a computer control system either primarily or wholly independent of input by a human during at least a significant portion of a given trip. Accordingly, vehicles having "autopilot" features during the cruising phase of a trip (e.g., automatic braking and accelerating, maintenance of lane) may be considered autonomous vehicles during such phases of the trip where the vehicle is primarily or wholly controlled by a computer independent of human input. Autonomous vehicles may be manned (i.e., one or more humans riding in the vehicle) or unmanned (i.e., no humans present in the vehicle). By way of illustrative example, and without limitation, autonomous vehicles may include so called "self-driving" cars, trucks, air taxis, drones, and the like.

Within the scope of the present disclosure, the terms "piloted vehicle", "human-piloted vehicle," and derivatives thereof generally refer to vehicles such as, without limitation, cars, trucks, motorcycles, aircraft, and watercraft that are wholly or substantially piloted by a human. For clarity, vehicles featuring assistive technologies such as automatic braking for collision avoidance, automatic parallel parking, cruise control, and the like shall be considered piloted vehicles to the extent that a human is still responsible for controlling significant aspects of the motion of the vehicle in the normal course of driving. A human pilot may be present in the piloted vehicle or may remotely pilot the vehicle from another location via wireless uplink. By way of illustrative example, and without limitation, piloted vehicles may include so called "self-driving" cars, trucks, air taxis, drones, and the like.

Within the scope of the present disclosure, the term "driving style" and derivatives thereof generally refer to patterns or tendencies indicative of the way a human driver typically pilots a piloted vehicle that may be useful to proximate vehicles for enhancing safety or driving experience. These characteristics may be identified over a period of time, such as over the course of a current trip and/or over the course of numerous trips occurring over the past week, month, year, etc., as appropriate. Driving characteristics can be evaluated for patterns and tendencies that other drivers and autonomous vehicles may wish to consider from safety and driver experience perspectives. For example, driving style can be characterized, in various embodiments, as a driver's tendency for aggressive actions such as rapidly accelerating and braking, following closely, dangerously changing lanes or changing lanes without signaling, drifting out of his/her lane, speeding, etc. Likewise, driving style may be characterized by a particular driver's tendencies for other dangerous or frustrating actions, such as driving well under the speed limit, accelerating very slowly from stops, frequently drifting out of lanes, late braking, etc. It should be appreciated that many of these tendencies may be characteristic of distracted driving (e.g., texting and driving) or overly timid driving styles. Additionally or alternatively, driving style can be characterized based on information concerning the driver's safety record, such as the number of accidents in which the driver has been involved, the nature of those accidents, and how recent those accidents were. Similarly, driving style may be characterized by the driver's tendencies to comply with traffic laws, such as how many traffic infractions the driver has committed (whether ticketed or not), the nature of those infractions, and how recent those infractions were. It should be recognized that driving style information may include any other information concerning identifiable characteristics of the way a human driver pilots a vehicle that may be useful to proximate vehicles for enhancing safety or driving experience.

Within the scope of the present disclosure, the term "driving experience" and derivatives thereof generally refer to characteristics of the trip experienced by occupant(s) (e.g., drivers, passengers, cargo) of surrounding vehicles, whether piloted or autonomous. Occupants, owners, or operators of surrounding vehicles may have certain preferences concerning how the trip is conducted and thus may wish to be warned of and/or have their vehicle automatically respond to the presence of nearby drivers having a driving style that may interfere with those preferences. Representative examples of driving experience preferences may include, without limitation, preferences concerning trip duration, trip smoothness (e.g., steady vs. stop-and-go), efficiency of power or fuel consumption, and tolerance levels for safety risks. While the present disclosure may frequently refer to an occupant's driving style preferences, this simplification is made for ease of explanation, and it should be understood that driving experience preferences may likewise be associated with persons and/or entities not present in the vehicle, such as the manufacturer, owners, or remote operator or manager of the piloted or autonomous vehicle. For example, an operator or manager, such as a remote pilot or fleet manager, respectively, may have driving experience preferences for the vehicle.

Further embodiments of the present disclosure include systems and methods for automatically generating warnings and/or automatically adjusting operation of the vehicle in response to receiving driving style information from nearby vehicles. Whether a response is executed and the nature of that response may depend at least in part on the preferred driving experience of vehicle occupants. In particular, the present systems and methods may be configured, in one aspect, to automatically generate and present warnings to occupants. For example, when a vehicle driven by a driver with historically aggressive driving style is nearby, a warning could be displayed and/or sounded to alert the receiving vehicle's driver so that he/she may decide whether to take action (e.g., move over, slow down) for minimizing risk of collision with the historically aggressive driver. In another aspect, the present systems and methods may be configured to automatically identify suitable adjustments to the current operation of an autonomous vehicle. Tracking the immediately preceding example, the system may identify, and in some cases automatically implement, one or more controls adjustments (e.g., move over, slow down) suitable for enhancing the driving experience of occupants of the autonomous vehicle. The system may consider safety and/or aspects of the manufacturer's and/or occupant's preferred driving experience in determining said controls adjustments, as later described in more detail.

FIG. 1 schematically depicts a representative system for collecting, evaluating, and sharing information concerning the driving style of a human driver with nearby vehicles. In particular, system 100 may be configured for collecting information concerning driving characteristics associated with a driver 210 of a piloted vehicle 200. The driving characteristics can be evaluated at various locations throughout system 100 for patterns and other information useful in characterizing the driving style of human driver 210, including at vehicle 200, vehicle 300, or a remote server 400 in various embodiments. The driving style information can be utilized by nearby piloted or autonomous vehicles 300 for enhancing their respective driving experiences, as later described in more detail.

Collecting Driving Characteristics

Figure 2:
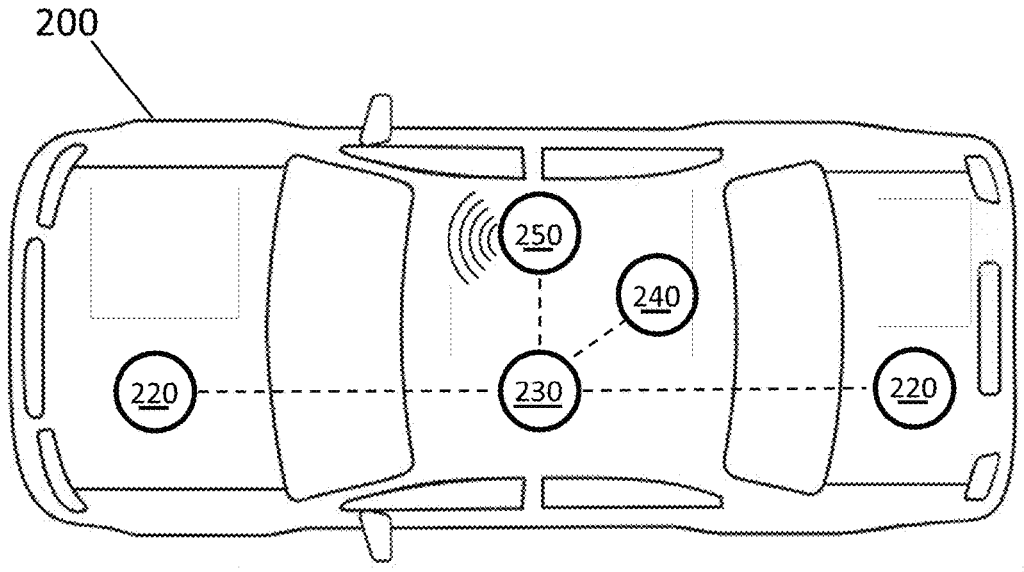
FIG. 2 is a schematic illustration of a sensing system onboard vehicle for collecting information concerning how a driver operates the vehicle during current and previous trips, according to an embodiment of the present disclosure.

FIG. 2 is a schematic illustration of a sensing system located onboard vehicle 200 for collecting information concerning how driver 210 operates vehicle 200 during current and previous trips (hereinafter "driving characteristics"). The sensing system, in various embodiments, may generally include one or more sensors 220, a processor 230, memory 240, and a transmitter 250.

The sensing system, in various embodiments, may include one or more sensors 220 configured to collect information regarding operational aspects of vehicle 200, such as speed, vehicle speed, vehicle acceleration, braking force, braking deceleration, when turn signals are utilized, and the like. Representative sensors configured to collect information concerning operational driving characteristics may include, without limitation, tachometers like vehicle speed sensors or wheel speed sensor, brake pressure sensors, fuel flow sensors, steering angle sensors, and the like.

The sensing system, in various embodiments, may additionally or alternatively include one or more sensors 220 configured to collect information regarding the static environment in which vehicle 200 is operated, such as the presence and content of signage and traffic signals (e.g., stop signs, construction zones, speed limit signs, stop lights), road lane dividers (e.g., solid and dashed lane lines), and the like. Representative sensors configured to collect such static operating environment information may include outward-facing cameras positioned and oriented such that their respective fields of view can capture the respective information each is configured to collect. For example, a camera configured to capture surrounding signage may be configured towards the front of or on top of vehicle 200 and oriented forward-facing (e.g., straight ahead or perhaps canted sideways by up to about 45 degrees) so as to capture roadside and overhead signage/traffic signals within its field of view as vehicle 200 travels forward. As another example, cameras configured to capture road lane dividers may be positioned on the side of or off a front/rear quarter of vehicle 200 and may be oriented somewhat downwards so as to capture road lane dividers on both sides of vehicle 200. Additional representative sensors for collecting static operating environment information may include receivers configured to receive wireless signals from base stations or other transmitters communicating information that may ordinarily be found on signage or otherwise related to the static operating environment of vehicle 200. Likewise, global positioning system (GPS) or other location-related sensors may be utilized to collect information regarding the static environment in which vehicle 200 is operated, such as what street vehicle 200 is driving on, whether that street is a traffic artery (e.g., highway) or other type, and whether that location is in an urban or rural area.

The sensing system, in various embodiments, may additionally or alternatively include one or more sensors 220 configured to collect information regarding the dynamic environment in which vehicle 200 is operated, such as information concerning the presence of other nearby vehicles such as each vehicle's location, direction of travel, rate of speed, and rate of acceleration/deceleration, as well as similar information concerning the presence of nearby pedestrians. Representative sensors configured to collect such dynamic operating environment information may include outward-facing cameras positioned and oriented such that their respective fields of view can capture the respective information each is configured to collect. For example, outward-facing cameras may be positioned about the perimeter of vehicle 200 (e.g. on the front, rear, top, sides, and/or quarters) to capture imagery to which image processing techniques such as vehicle recognition algorithms may be applied. Additionally or alternatively, one or more optical sensors (e.g., LIDAR, infrared), sonic sensors (e.g., sonar, ultrasonic), or similar detection sensors may be positioned about the vehicle for measuring dynamic operating environment information such as distance, relative velocity, relative acceleration, and similar characteristics of the motion of nearby vehicles 300.

The sensing system, in various embodiments, may leverage as sensor(s) 220 those sensors typically found in most piloted vehicles today such as, without limitation, those configured for measuring speed, RPMs, fuel consumption rate, and other characteristics of the vehicle's operation, as well as those configured for detecting the presence of other vehicles or obstacles proximate the vehicle (e.g., sensors used to alert the driver to the presence of a vehicle in the driver's blind spot, backup sensors, forward detection sensors for automatic collision-avoidance braking). Sensors 220 may additionally or alternatively comprise aftermarket sensors installed on vehicle 200 for facilitating the collection of additional information for purposes relate or unrelated to evaluating driving style.

The sensing system of vehicle 200, in various embodiments, may further comprise an onboard processor 230, onboard memory 240, and an onboard transmitter 250. Generally speaking, in various embodiments, processor 230 may be configured to execute instructions stored on memory 240 for processing information collected by sensor(s) 200 for subsequent transmission offboard vehicle 200. Onboard processor 230, in various embodiments, may additionally or alternatively be configured to execute instructions stored on memory 240 for processing information from two or more sensors 220 to produce further information concerning driving characteristics associated with driver 210. For example, in an embodiment, processor 230 may process operational characteristics, such as braking deceleration, alongside dynamic environment characteristics, such as following distance, to determine for example whether instances of hard braking are associated with following another vehicle too closely as opposed to more innocuous circumstances such as attempts to avoid debris or an animal suddenly appearing in the roadway. It should be recognized that this is merely an illustrative example, and that one of ordinary skill in the art will recognize further ways sensor data may be processed by processor 130 to produce further information concerning driving characteristics associated with driver 210 in light of the teachings of the present disclosure.

Like sensor(s) 220, in various embodiments, processor 230 and/or onboard transmitter 240 of system 100 may be integrally installed in vehicle 200 (e.g., car computer, connected vehicles), while in other embodiments, processor 230 and/or transmitter 240 may be added as an aftermarket feature. For example, in one such embodiment, existing piloted vehicles 200 may be outfitted with a device that includes one or both of processor 230 and transmitter 240 and that can be plugged into an OBD-II port of vehicle 200. As configured, the device could interface with sensor(s) 220 that are in communication with the OBD-II system of vehicle 200, as well as draw electrical power from vehicle 200, thereby providing a solution that can be easily retrofitted onto existing piloted vehicles 200.

Onboard and/or Offboard Evaluation of Driving Characteristics

Referring now to FIGS. 3A-3E, in various embodiments, system 100 may be configured to evaluate driving characteristics associated with driver 210 for one or more patterns indicative of a particular driving style. According to various embodiments of the present disclosure, these evaluations may be performed either onboard vehicle 200 or at an offboard location, as explained in further detail below.

Figure 3A:
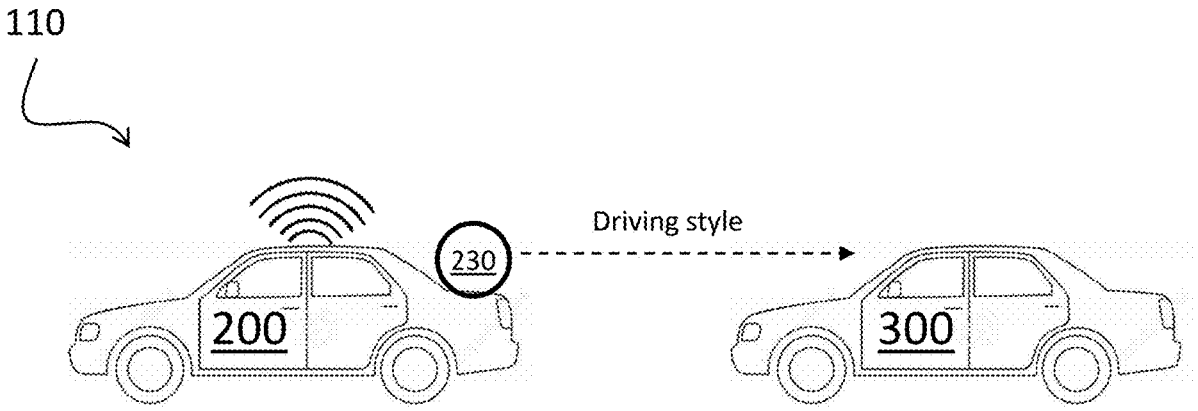
FIGS. 3A and 3B schematically illustrate embodiments of the system in which evaluation of driving characteristics occurs onboard the piloted, according to an embodiment of the present disclosure.
Figure 3B:
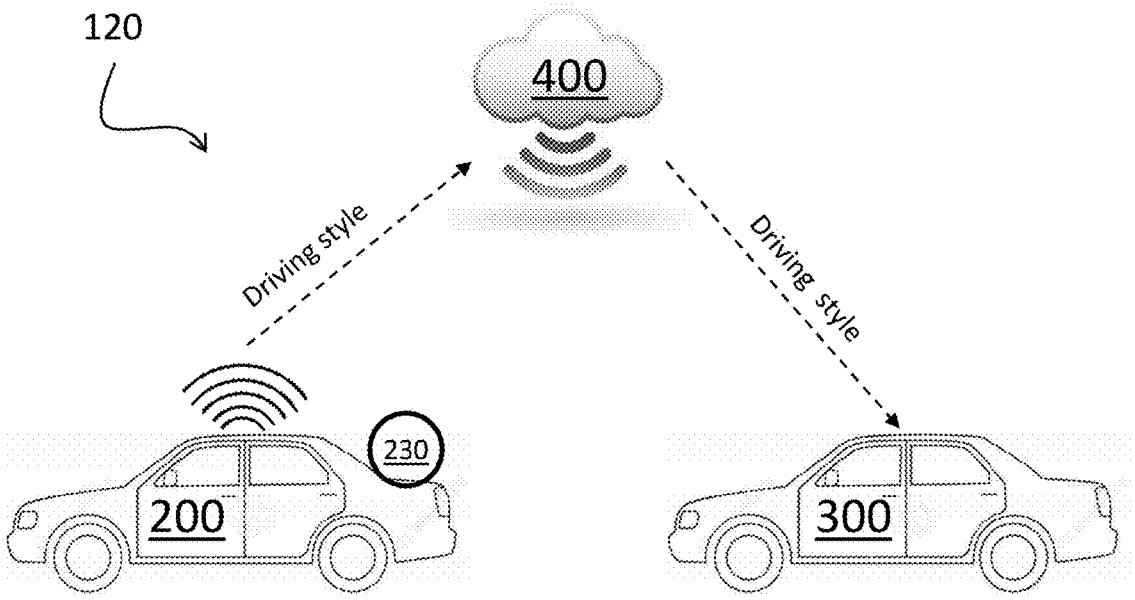

FIGS. 3A and 3B schematically illustrate embodiments 110 and 120, respectively, in which the evaluation of driving characteristics information may occur onboard vehicle 200. In one such embodiment, processor 230 may be configured to execute instructions stored on memory 240 for evaluating driving characteristics collected by sensor(s) 220 in accordance with methodologies later described in more detail. Patterns and other information relevant to characterizing driving style (or in some embodiments, characterizations of driving style itself) resulting from evaluation of the driving characteristics may then be transmitted to vehicle 300 via transmitter 240. In embodiment 110, driving style information may be sent directly to vehicle 300 as shown in FIG. 3A, whereas in embodiment 120, driving style information may be sent indirectly to vehicle 300 via remote server 400 as shown in FIG. 3B. In the latter embodiment 120, remote server 400 may immediately relay the driving characteristics to vehicle 300 or may store driving style information associated with driver 210 from the current and/or past trips. Remote server 400 may then transmit current and/or historical driving style information to vehicle 300 when requested by vehicle 300 or when directed to do so by vehicle 200.

It should be appreciated that embodiments in which driving characteristics are evaluated onboard vehicle 200 may have certain benefits. In many cases, one such benefit may be that transmitting driving style information may require less bandwidth than transmitting raw or pre-processed driving characteristics information, as in many cases driving style information may represent a more distilled version of driving characteristics information. Further, with reference to embodiment 120 in particular, it may be beneficial to transmit driving style information for storage on remote server 400. In one aspect, this may allow remote server 400 to offload storage responsibility from vehicle 200, thereby reducing the amount of memory (e.g., memory 240) required on vehicle 200. In another aspect, by storing driving style information on remote server 400, vehicle 300 may access driving style information from remote server 400 without needing to establish a communications link with vehicle 200. First, this may improve security as it may be easier to implement robust security protocols and monitoring on communications between vehicles and remote server 400 than on vehicle-to-vehicle communications. Second, vehicle 300 may be able to access driving style information stored in remote server 400 for at least past trips of driver 210 in the event vehicle 200 is unable to or otherwise does not establish communications links with remote server 400 or vehicle 300 during the current trip. One of ordinary skill in the art may recognize further benefits to this architecture within the scope of present disclosure.

Processor 230, in various embodiments, may be configured to pre-process information from sensor(s) 220 for subsequent offboard transmission via transmitter 240. Pre-processing activities may include one or a combination of filtering, organizing, and packaging the information from sensors 220 into formats and communications protocols for efficient wireless transmission. In such embodiments, the pre-processed information may then be transmitted offboard vehicle 200 by transmitter 240 in real-time or at periodic intervals, where it may be received by nearby vehicles 300 and/or remote server 400 as later described in more detail. It should be appreciated that transmitter 240 may utilize short-range wireless signals (e.g., Wi-Fi, BlueTooth) when configured to transmit the pre-processed information directly to nearby vehicles 300, and that transmitter 240 may utilize longer-range signals (e.g., cellular, satellite) when transmitting the pre-processed information directly to remote server 400, according to various embodiments later described. In some embodiments, transmitter 240 may additionally or alternatively be configured to form a local mesh network (not shown) for sharing information with multiple vehicles 300, and perhaps then to remote server 400 via an wide area network access point. Transmitter 240 may of course use any wireless communications signal type and protocol suitable for transmitting the pre-processed information offboard vehicle 200 and to nearby vehicles 300 and/or remote server 400.

Figure 3C:
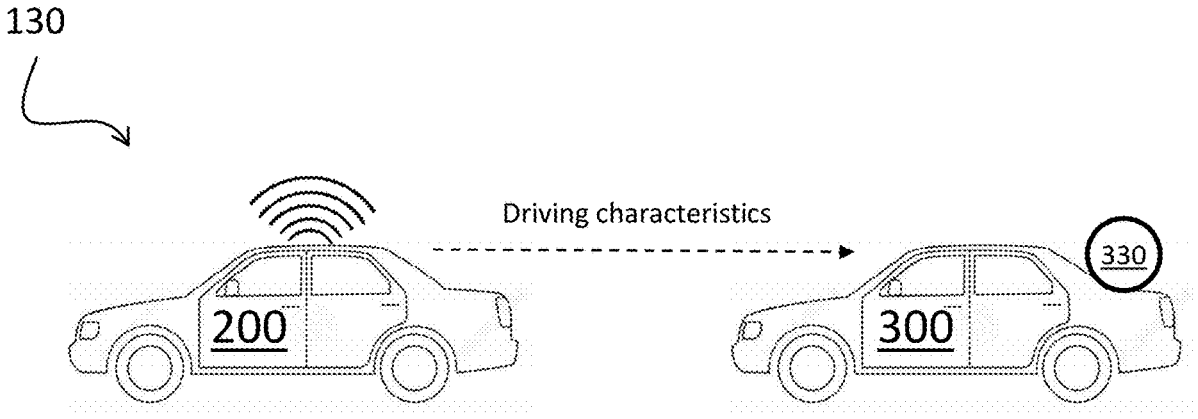
FIGS. 3C and 3D schematically illustrate embodiments of the system in which evaluation of driving characteristics occurs onboard a nearby piloted or autonomous vehicle, according to an embodiment of the present disclosure.
Figure 3D:
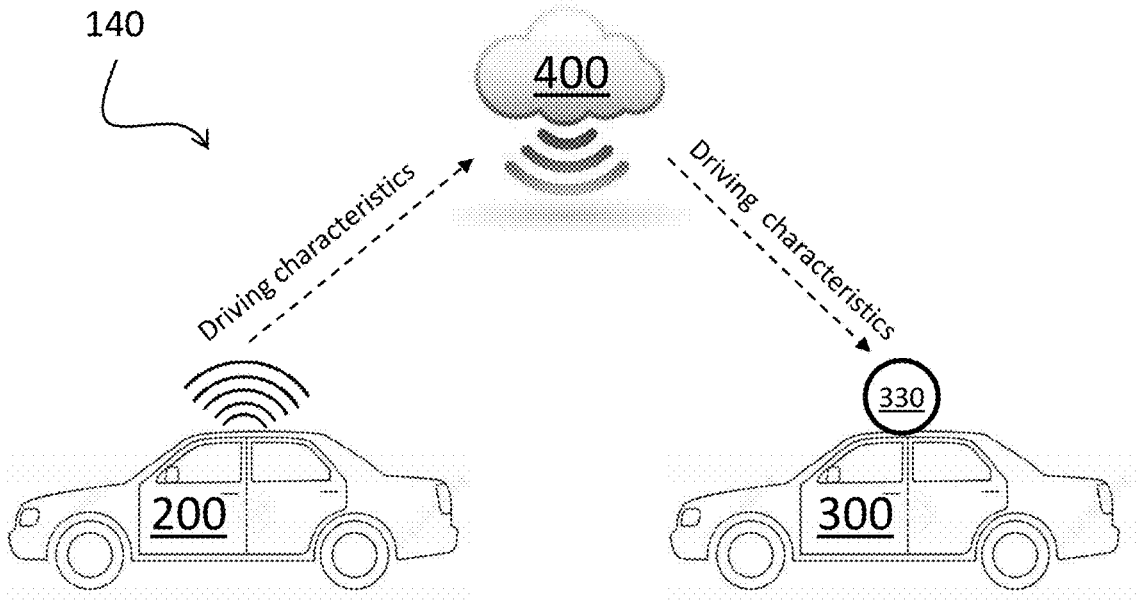

FIGS. 3C and 3D schematically illustrate embodiments 130 and 140, respectively, in which the evaluation of driving characteristics information may occur offboard vehicle 200. In particular, FIGS. 3C and 3D illustrate embodiments in which evaluation is performed onboard vehicle 300. In one such embodiment, system 100 may further include a processor 330 configured to execute instructions stored on a memory 340 (also located onboard vehicle 300, in an embodiment) for evaluating driving characteristics transmitted from vehicle 200 (e.g., via transmitter 250). In embodiment 130, for example, driving characteristics may be sent directly to vehicle 300 as shown in FIG. 3C, whereas in embodiment 140, driving style information may be sent indirectly to vehicle 300 via remote server 400 as shown in FIG. 3D. In the latter embodiment 140, remote server 400 may immediately relay the driving characteristics to vehicle 300 or instead store the driving characteristics from the current and/or past trips. Remote server 400 may then transmit current and/or historical driving characteristics to vehicle 300 when requested by vehicle 300 or when directed to do so by vehicle 200.

It should be appreciated that embodiments in which driving characteristics are evaluated onboard vehicle 300 may have certain benefits. In many cases, occupants 310 of vehicle 300 may prefer that their own vehicle (i.e., vehicle 300) evaluate driving characteristics associated with driver 210 rather than a third-party processor (e.g., processor 230 of vehicle 200 or processor 430 of remote server 400, later described). In this way, occupants 310 may be more confident that the evaluation, for example, was performed to produce the most useful data possible for enhancing their specific driving experience preferences as opposed to receiving, for example, a one-size-fits-all characterization of driving style from a third-party (e.g., vehicle 200 or remote server 400). Further, with reference to embodiment 140 in particular, it may be beneficial to transmit driving characteristics from vehicle 200 for storage on remote server 400 for reasons similar to those associated with transmitting driving style information for storage on remote server 400. In one aspect, this may allow remote server 400 to offload storage responsibility from vehicle 200, thereby reducing the amount of memory (e.g., memory 240) required on vehicle 200 for storing driving characteristics. In another aspect, by storing driving characteristics on remote server 400, vehicle 300 may access driving style information from remote server 400 without needing to establish a communications link with vehicle 200. First, this may improve security as it may be easier to implement robust security protocols and monitoring on communications between vehicles and remote server 400 than on vehicle-to-vehicle communications. Second, vehicle 300 may be able to access driving characteristics stored in remote server 400 for at least past trips of driver 210 in the event vehicle 200 is unable to or otherwise does not establish communications links with remote server 400 or vehicle 300 during the current trip. One of ordinary skill in the art may recognize further benefits to this architecture within the scope of present disclosure.

Figure 3E:
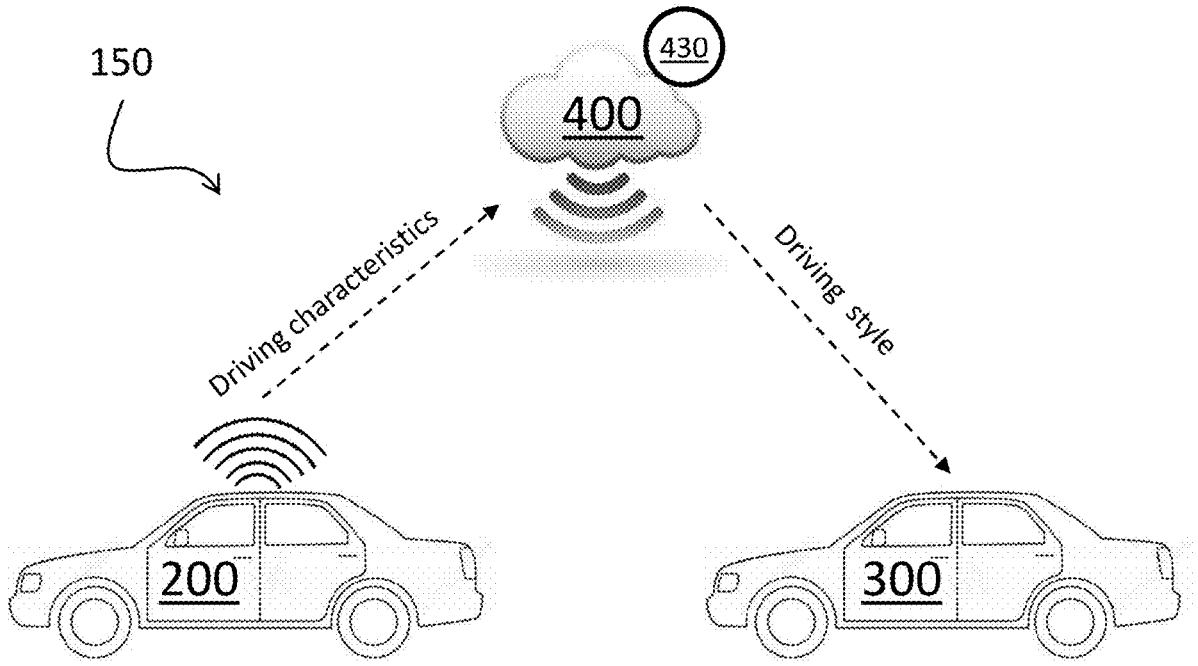
FIG. 3E schematically illustrates an embodiments of the system in which evaluation of driving characteristics occurs at a remote server, according to an embodiment of the present disclosure.

FIG. 3E schematically illustrates another embodiment 150 in which the evaluation of driving characteristics information may occur offboard vehicle 200. In particular, FIG. 3E illustrate an embodiment in which evaluation is performed at remote server 400. In one such embodiment, system 100 may further include a processor 430 configured to execute instructions stored on a memory 440 (also located offboard vehicle 200 and at or in communication with remote server 400, in an embodiment) for evaluating driving characteristics transmitted from vehicle 200 (e.g., via transmitter 250). In embodiment 150, for example, driving characteristics may be sent directly to remote server 400 for evaluation at remote server 400 as shown in FIG. 3E. Remote server 400 may then transmit current and/or historical driving style information to vehicle 300 when requested by vehicle 300 or when directed to do so by vehicle 200.

It should be appreciated that embodiments in which driving characteristics are evaluated at remote server 400 may have certain benefits. In many cases, one such benefit may be that transmitting driving style information may require less bandwidth than transmitting raw or pre-processed driving characteristics information, as in many cases driving style information may represent a more distilled version of driving characteristics information. While this particular benefit may be limited to communicating driving style from remote server 400 and vehicle 300, as opposed to additionally benefiting communications from vehicle 200 to either vehicle 300 or remote server 400 as in embodiments 110 and 120, respectively, the benefit exists nonetheless.

Further, occupants 310 of vehicle 300 may prefer that remote server 400, and not vehicle 200, evaluate driving characteristics associated with driver 210. In this way, occupant(s) 310 may be more confident that the evaluation, for example, was performed by a more trusted source (e.g., remote server 400). In an embodiment, remote server 400 could even be programmed to first request driving experience preferences from vehicle 300 (or allow them to be pre-set in remote server 400) such that remote server 400 can then evaluate the driving characteristics in a manner that produces the most useful data possible for enhancing the specific driving experience preferences of occupant(s) 310 of vehicle 300.

Still further, it may be beneficial to transmit driving characteristics from vehicle 200 for storage on remote server 400 for reasons similar to those described with reference to embodiment 140. This may allow remote server 400 to offload storage responsibility from vehicle 200, thereby reducing the amount of memory (e.g., memory 240) required on vehicle 200 for storing driving characteristics.

Further benefits may exist similar to those described with respect to embodiment 120 in terms of storing driving style on remote server 400. In particular, as configured, vehicle 300 may access driving style information from remote server 400 without needing to establish a communications link with vehicle 200. First, this may improve security as it may be easier to implement robust security protocols and monitoring on communications between vehicles and remote server 400 than on vehicle-to-vehicle communications. Second, vehicle 300 may be able to access driving style information stored in remote server 400 for at least past trips of driver 210 in the event vehicle 200 is unable to or otherwise does not establish communications links with remote server 400 or vehicle 300 during the current trip.

Yet further benefits may be derived from evaluating the driving characteristics at remote server 400. In one aspect, embodiment 150 may leverage enhanced computational power and storage capabilities at remote server 400 as opposed to perhaps more limited computational and storage capabilities on mobile platforms associated with vehicles 200, 300. In another aspect, performing evaluations at a central location can ensure consistent approaches are used across system for characterizing driving style. Still further, in another aspect, performing evaluations at a central location may allow for embodiment 150 to leverage big data analytics techniques for constantly improving evaluation techniques. In particular, the multitude of evaluations performed at remote server could be analyzed, perhaps along with feedback from vehicles 300 and/or occupants 310 across the system, to figure out what works best and what does not work as well based on actual empirical data and thereby improve evaluation techniques. In yet another aspect, remote server 400 may be configured to store driving characteristics associated with various drivers 210 and apply the constantly improving evaluation methods over time. One of ordinary skill in the art may recognize further benefits to this architecture within the scope of present disclosure.

Various transmissions of driving characteristics and/or driving style information amongst the various combinations of vehicle 200, vehicle 300, and remote server 400 of system 100 may be initiated in accordance with any suitable requests, commands, and the like from any suitable source within system 100. For example, with reference to embodiments 110 and 130 (i.e., local transmission amongst vehicles 200,300), vehicle 300 may detect the presence of vehicle 200 and send a request to vehicle 200 for the driving characteristics/driving style information. Similarly, vehicle 200 may instead detect the presence of vehicle 300 and push its driving characteristics/driving style information to vehicle 300. In another example, vehicle 300 may detect the presence of vehicle 200 and send a request to remote server 400 for the driving characteristics/driving style information for vehicle 200. In one such embodiment, vehicle 300 may identify vehicle 200 based on an identification beacon emitted by vehicle 200, wherein the beacon contains information suitable for accessing corresponding driving characteristics/driving style information from remote server 400. In another such embodiment, vehicle 300 may capture an image of vehicle's 200 license plate or other visual identifier (e.g., a barcode sticker affixed to vehicle 200) and transmit the image or identifier to remote server 400 for identification.

Characterizing Driving Style Based on Driving Characteristics

Figure 4:
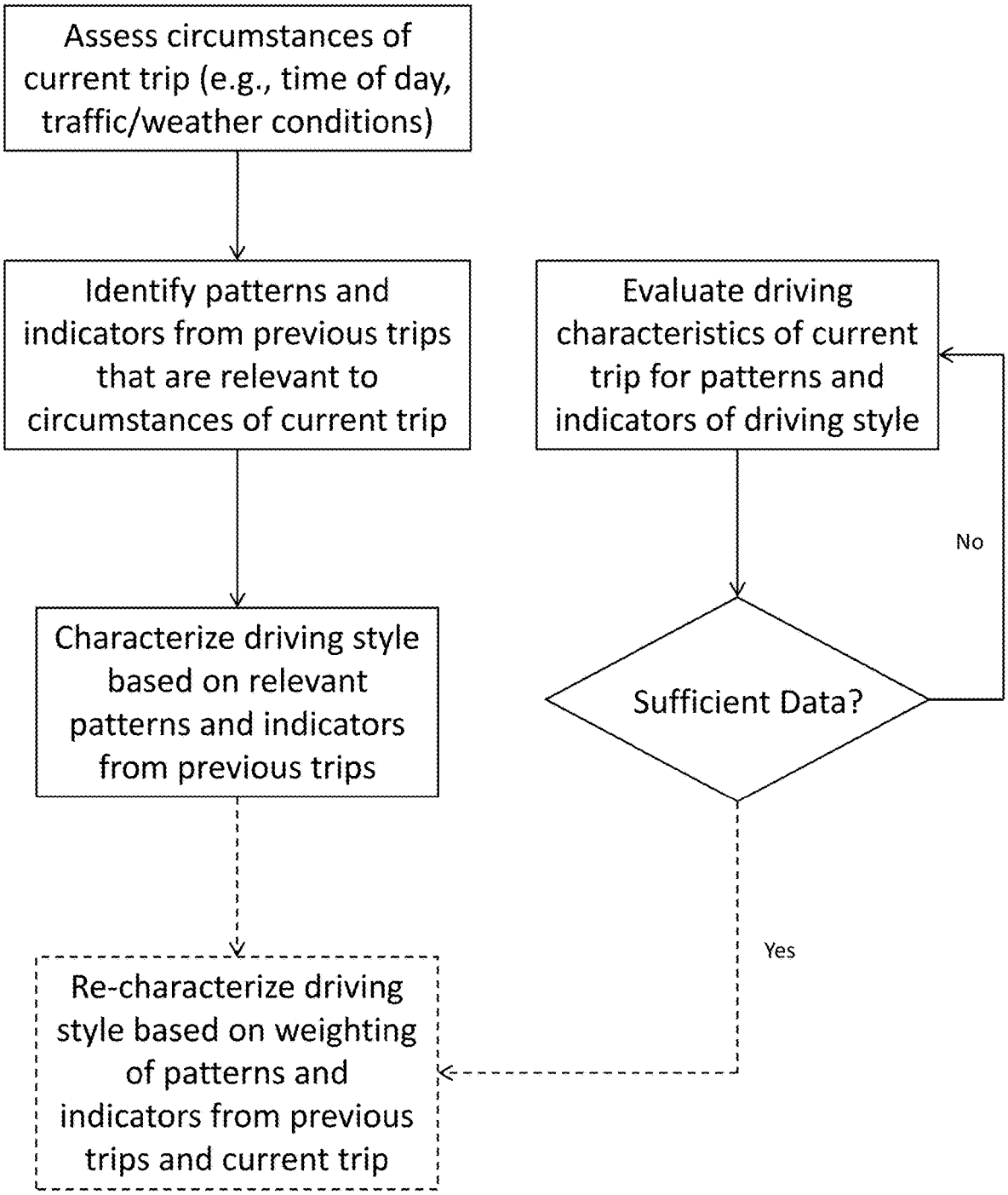
FIG. 4 is a flow chart illustrating a representative approach for automatically characterizing the driving style of a driver based on corresponding driving characteristics, according to an embodiment of the present disclosure.

FIG. 4 is a flow chart illustrating a representative approach for automatically characterizing the driving style of driver 210 based on corresponding driving characteristics collected from vehicle 200. In various embodiments, characterizing driving style may generally include evaluating the driving characteristics collected by sensor(s) 220 to identify patterns and other indicators suitable for characterizing the driving style of driver 210, as further described in more detail below. In various embodiments, processor 130 may be configured to perform the steps of evaluating and characterizing, whether processor 130 is located onboard or off-board vehicle 200 depending on the particular embodiment.

The process, in various embodiments, may begin by considering information collected by sensor(s) 220 concerning driving characteristics of the current trip. On the one hand, driving characteristics collected during the current trip may best correlate with the present driving style of driver 210, and therefore may provide the best insight since driving style can vary from trip-to-trip as well as vary throughout the course of the current trip. Many factors may affect driving style at any given time, such as severity of traffic, weather conditions, time of day (e.g., rushed going to work vs. relaxed headed home from the gym), where the trip occurs, the duration of the trip, the presence of passengers in vehicle 200 (which could, in an embodiment, be detected by pressure sensors in seat bottoms), amongst other relevant factors. On the other hand, it can be difficult to characterize driving style for the current trip until enough data is collected to identify patterns and other indicators of driving style during the current trip.

Accordingly, in various embodiments, the process may additionally or alternatively consider information from one or more past trips. As shown in FIG. 4, in one such embodiment, the process may begin utilizing information solely from previous trips. In particular, the process may begin by assessing the relevant circumstances of the current trip. As previously noted, circumstances of a particular trip may affect—or otherwise are able to be correlated with—current driving style. Thus, it may be possible to better estimate the current driving style of driver 210 by looking at his/her driving style under similar circumstances during past trips. The process may evaluate driving characteristics associated with those past trips under similar circumstances, and attempt to identify associated trends. Those historical trends, which are associated with past trips taken under similar circumstances, can then be used to estimate current driving style.

For clarity, in some embodiments, current driving style may always be characterized based on past trips, and more accurately, those trips taken under similar circumstances. In other embodiments, as shown in FIG. 4, current driving style may initially be estimated based on past trips as described, but may subsequently be re-characterized when sufficient data is available from the current trip. In particular, the process may include continuously or periodically evaluating driving characteristics collected during the current trip to determine if sufficient data is available to reliably identify patterns or indicators of current style. When sufficient data is available, the process may include comparing the identified patterns and indictors from the current trip with those estimated based on past trips under similar circumstances. To the extent the current and past patterns and indicators differ, driving style may be re-characterized by either using only the current patterns and indicators or instead determining a blended driving style using a weighted average, for example, of past patterns/indicators with current patterns/indicators.

Overall driving style, in various embodiments, can be characterized at a macro-scale (e.g., overall aggressive, erratic, average, indecisive, passive), while in other embodiments, driving style may additionally or alternatively be broken down into various categories of interest (e.g., tendencies to speed or creep, tendencies to brake hard, tendencies to follow at unsafe distances) and each characterized on a scale, such as a scale of 1-10. As configured, system 100 may optimize the amount of information being processed and shared amongst the components of the system to achieve a desired balance of transmission speed (i.e., more info, slower transmission) and information fidelity (i.e., more information, better intelligence). Further, system 100 may be configured to allow individual users to apply settings and permissions for what information they see and how it is presented, thereby enhancing human factors. Still further, such a configuration may similarly allow drivers 210 to control what information is transmitted to nearby vehicles 300 or remote server 400, thereby provide a level of control of data sharing privacy.

Automatic Warnings and Adjustments Based on Driving Style

Figure 5:
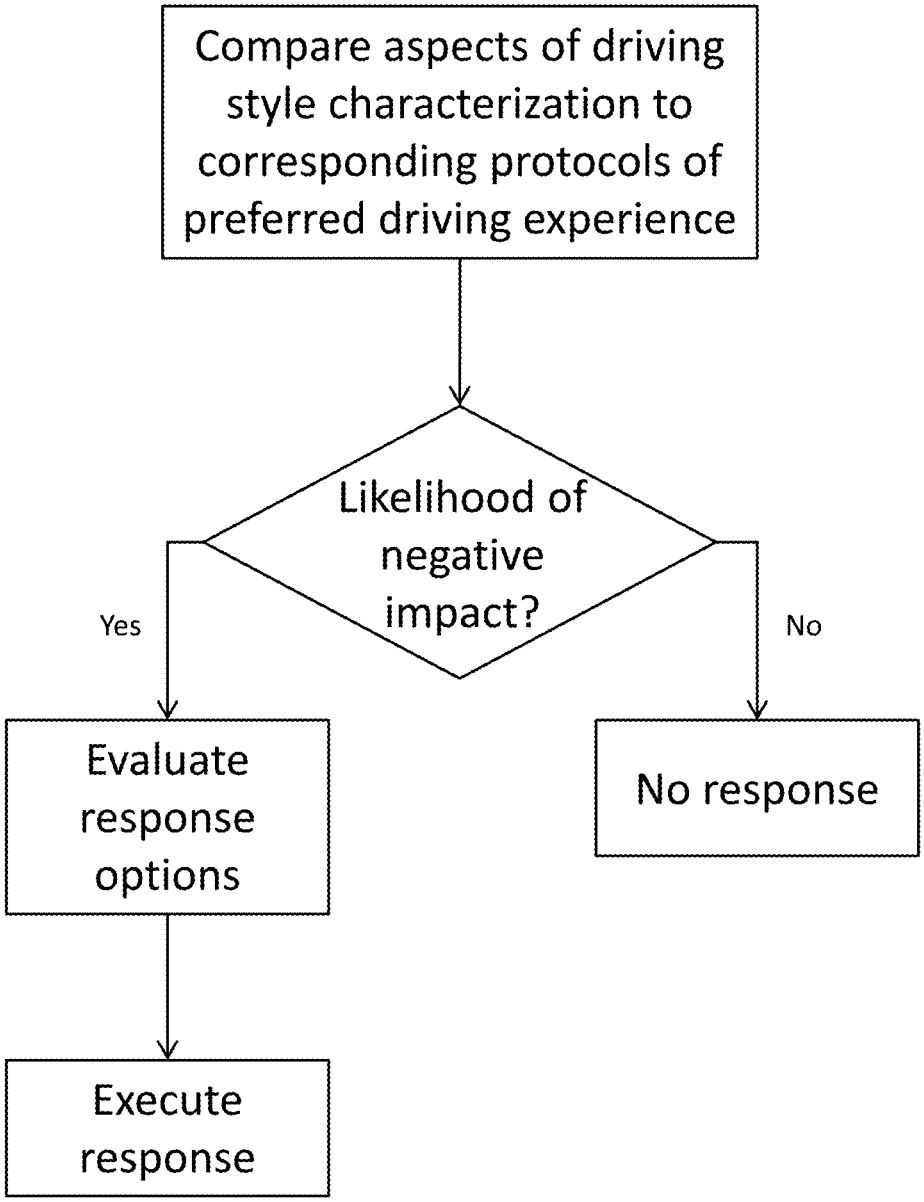
FIG. 5 is a flow chart illustrating a representative approach for generating automatic responses in nearby vehicles based on information concerning the driving style of the driver.

FIG. 5 is a flow chart illustrating a representative approach for generating automatic responses in nearby vehicles 300 based on information concerning the driving style of a nearby driver 210. In particular, in various embodiments, system 100 may be configured to automatically warn occupant(s) 310 of nearby piloted or autonomous vehicles 300 when the driving style of driver 210 is likely to or may otherwise degrade the preferred driving experience of occupant(s) 310. Additionally or alternatively, system 100 may be configured to automatically adjust the operation of nearby autonomous vehicles 300 when the driving style of driver 210 is likely to or may otherwise degrade the preferred driving experience of occupant(s) 310.

The process, in various embodiments, may begin by comparing the driving style of driver 210 with corresponding aspects of the preferred driving experience of occupant (s) 310. As previously described, driving experience may be characterized by a number of factors including, for example, preferences concerning trip duration, efficiency of power or fuel consumption, and tolerance levels for safety risks. Many aspects of driving style can be associated with and assigned a likelihood of affecting each of the factors characterizing driving experience. For example, driver's 210 tendency to speed, follow at unsafe distances, and change lanes unsafely may have a high likelihood of negatively impacting a safety- and comfort-focused driving experience preferred by occupant(s) 310 of nearby vehicle 300. Likewise, a driver's 210 tendency to accelerate and brake quickly may have a high likelihood of negatively impacting the preferred driving experience of green-minded occupant(s) 310 that value efficient fuel consumption in vehicle 300, as vehicle 300 may otherwise unnecessarily speed up and slow down frequently when following vehicle 200 in traffic. As configured, system 100 may compare driving style and driving experience to identify whether and how likely driver's 210 driving style may negatively impact occupant(s)'s 310 preferred driving experience.

Figure 6:
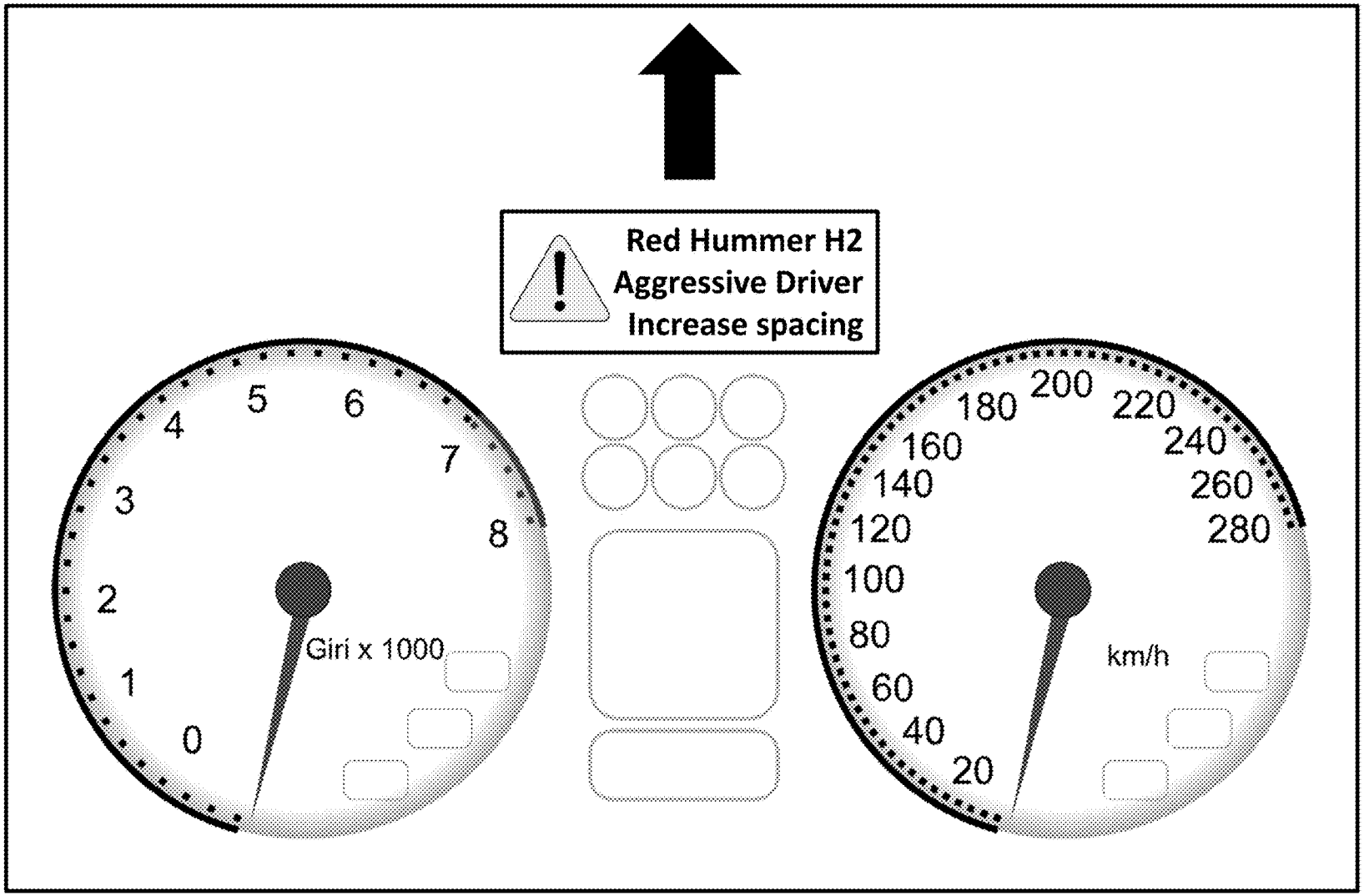
FIG. 6 depicts a representative warning generated for consideration by a driver of a nearby vehicle, according to an embodiment of the present disclosure.

In the event system 100 determines that the driving style of driver 210 is likely to negatively affect the preferred driving experience of occupant(s) 310, system 100 may be configured to, in response, evaluate potential options for enhancing the preferred driving experience. Referring to FIG. 6, in embodiments in which vehicle 300 is a piloted vehicle, system 100 may be configured to evaluate response options in the form of generating warnings for consideration by the driver 310 of nearby piloted vehicle 300. Warnings may be in any form suitable for notifying the driver 310 of piloted vehicle 300 about aspects of the driving style of driver 210 that may negatively affect the preferred driving experience of the driver 310 of piloted vehicle 300. For example, warnings may be visual, audible, tactile, or any combination thereof. In the example shown in FIG. 6, a visual warning is presented to the driver 310 of piloted vehicle 300 notifying the driver 310 that the driver 210 of a red Hummer H2 has an aggressive driving style and suggests increasing spacing between the vehicles 200, 300 in response. An arrow points ahead in the direction of vehicle 200 in this example to facilitate the driver 310 of vehicle 300 in identifying the vehicle 200 in question with minimal distraction. By presenting the driver 310 of vehicle 300 with this warning, the driver 310 may consider taking action to enhance his/her preferred driving experience.

Figure 7:
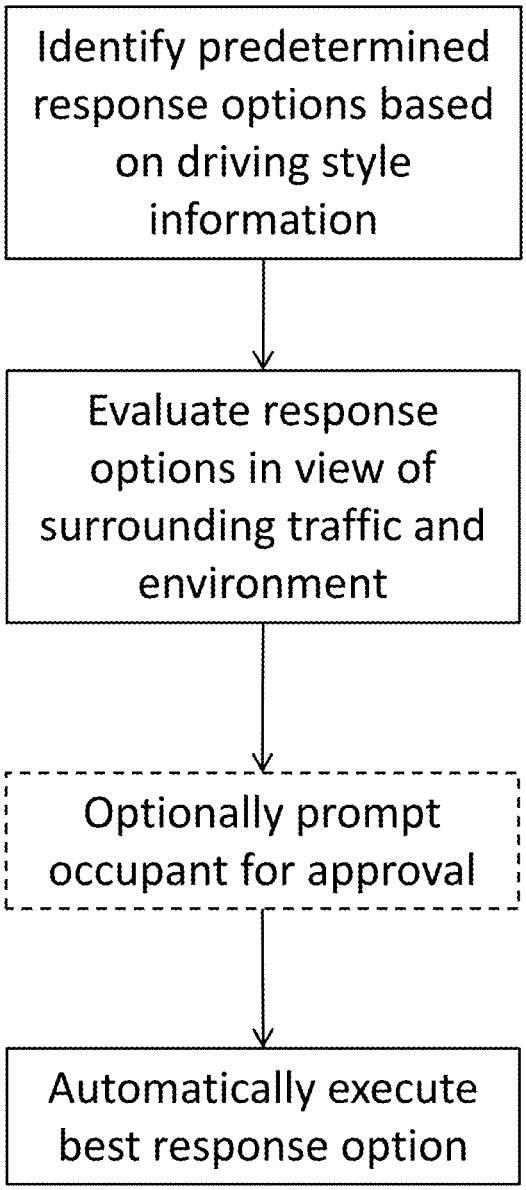
FIG. 7 is a flow chart illustrating a representative approach for evaluating response options in the form of warnings to occupants of nearby vehicles and/or automatic adjustments in the operation of nearby vehicles, according to an embodiment of the present disclosure.

Referring to FIG. 7, in embodiments in which vehicle 300 is an autonomous vehicle, system 100 may be configured to evaluate response options in the form of warnings to occupant(s) 310 and/or automatic adjustments in the operation of vehicle 300. Warnings may be similar to those described above, and in some embodiments, may further include the option of first requesting input from occupant(s) 310 as to whether they would like system 100 to automatically implement controls adjustments in response to the presence of vehicle 200. For example, system 100 may be configured to visually and/or audibly alert occupant(s) 310 to the presence and driving style of driver 210, present one or more options for automatically adjusting the operation of vehicle 300, and asking occupant(s) 310 which option it prefers (including, in some cases, taking no action). As configured, occupant(s) 310 may feel more comfortable or in control.

Automatic adjustments to the operation of vehicle 300 may include, without limitation, controls adjustments for changing lanes, slowing down, or passing. In various embodiments, system 100 may identify one or more predetermined response options from a database. The database, in an embodiment, may store and associate a variety of response options with a variety of situations, each situation being characterized at least in part by a combination of preferred driving experience and driving style. For example, for a situation characterized by an aggressive driver 210 pulling in front of a safety-minded occupant(s) 310, the database may present suitable response options such as slow down (i.e., increase spacing) or change lanes so that occupant(s) 310 is no longer following directly behind driver 210. The database may be stored locally on vehicle 300 or remotely such as on remote server 400.

System 100, in various embodiments, may be configured to then evaluate suitable response options for the given combination of driving style and driving experience in view of the surrounding traffic and environment to determine which identified response option(s) can be safely and/or expeditiously executed. It should be recognized that autonomous vehicles utilize a variety of sensors for understanding the surrounding environment, and that these sensors may be leveraged for this purpose according to approaches known in the art.

Upon determining one or more options for adjusting the current operation of vehicle 300 in response to the presence of driver 210, system 100 in an embodiment may automatically select and execute a suitable option. As previously described and shown in FIG. 7, in an embodiment, system 100 may optionally prompt occupant(s) 310 for approval and/or input as to which option to execute prior to executing the adjustment.

As with processing driving characteristics information, processing associated with determining and executing automatic responses to driving style information may occur locally at vehicle 300 or remotely, such as in remote server 400. In the latter case, response options in an embodiment may be sent to vehicle 300 for further evaluation in view of surrounding traffic and environment to minimize the dangers potentially posed by lag associated with performing this step remotely rather than locally at vehicle 300.

It should be appreciated that, in some cases, it may be beneficial to utilize a central database of response options when identifying suitable response options. In various embodiments, system 100 may leverage large amounts of empirical data to optimize such a central database. For example, system 100 may process feedback from a plurality of vehicles 300 regarding how often each option is chosen in each situation, as well as feedback occupant(s) 310 regarding whether they believe that response option worked out well in practical reality, to assess the suitability of each option and suggest preferred response options to vehicles 300. In some embodiments, artificial intelligence may be utilized to perform even more robust optimization continuously, thereby improving the decision-making abilities of system 100.

Figure 8A:
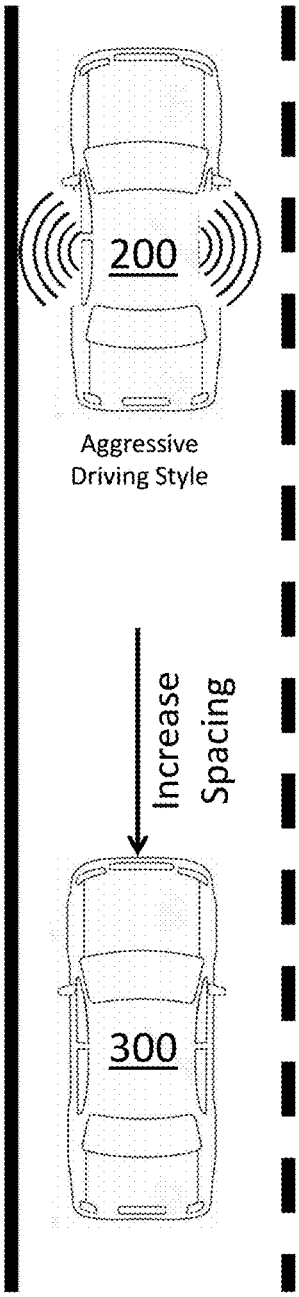
FIGS. 8A-8D illustrate representative examples of how the present systems and methods may be utilized for enhancing the driving experience of occupant(s) of piloted vehicles and autonomous vehicles, in accordance with various embodiments of the present disclosure.
Figure 8B:
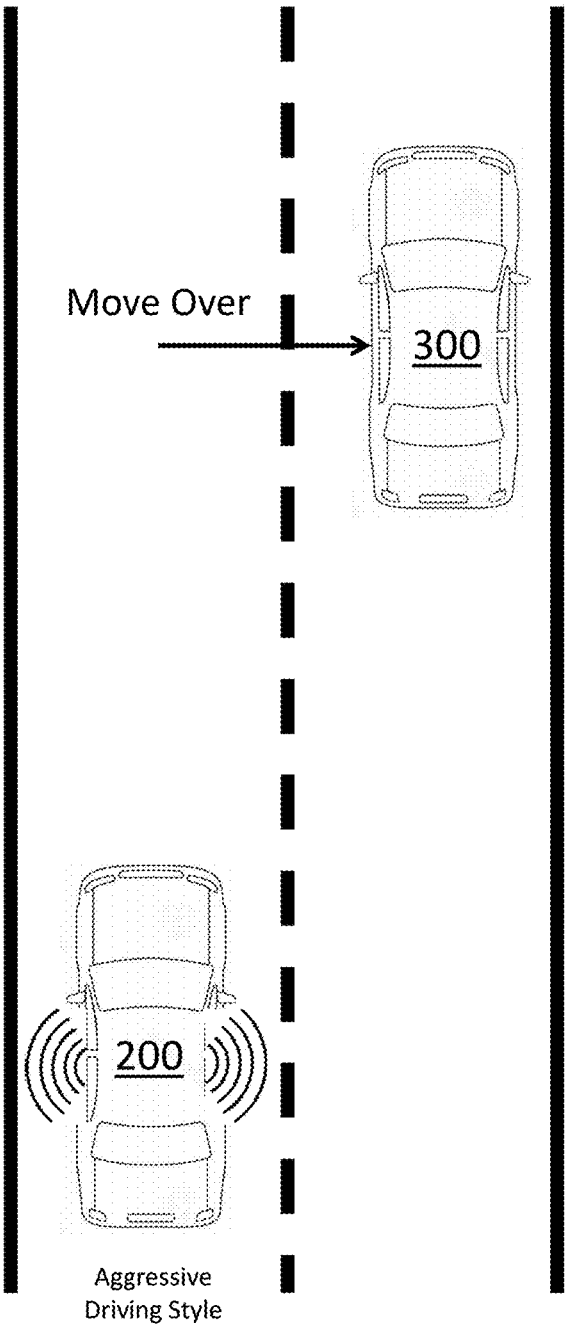

FIGS. 8A-8D illustrate representative examples of how the present systems and methods may be utilized for enhancing the driving experience of occupant(s) of piloted vehicles and autonomous vehicles. Referring first to FIGS. 8A and 8B, consider that piloted vehicle 200 is being piloted by a driver 210 (not shown) having a driving style largely characterized by aggressive tendencies, and that occupant(s) 310 of nearby vehicle 300 prefer a driving experience characterized by a high level of safety. Upon receiving driving style information concerning driver 210 piloted vehicle 100, the nearby vehicle 300 (more specifically, its occupant(s) 310 or autonomous control system) may take action in response to mitigate potential risks posed by the historically aggressive tendencies of driver 210 of piloted vehicle 200. In the example of FIG. 8A, vehicle 300 is travelling behind vehicle 200 and may opt to further increase its spacing from vehicle 200 (beyond usual spacing distances), thereby giving vehicle 300 more time to take evasive action given the potentially higher risk posed by the presence of historically aggressive driver 210. In the example of FIG. 8B, vehicle 200 is approaching vehicle 300 from behind, and in light of the potentially higher risk posed by the historically aggressive driving style of driver 210, vehicle 300 may opt to move over to the next lane so as to avoid being tailgated, thereby enhancing the driving experience of occupant(s) 310 in vehicle 300.

Figure 8C:
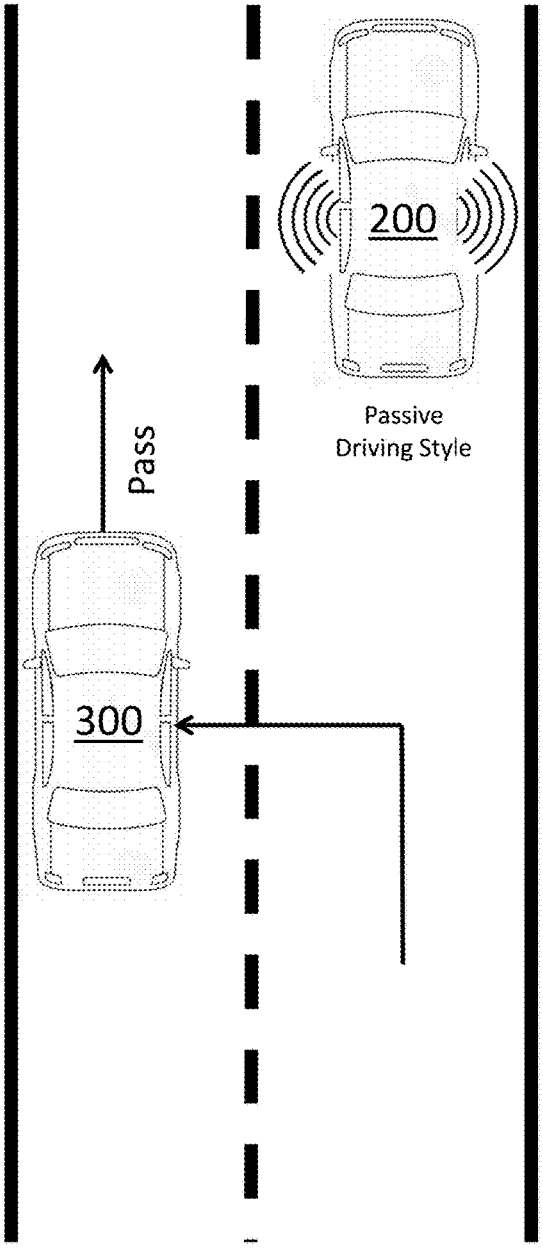
Figure 8D:
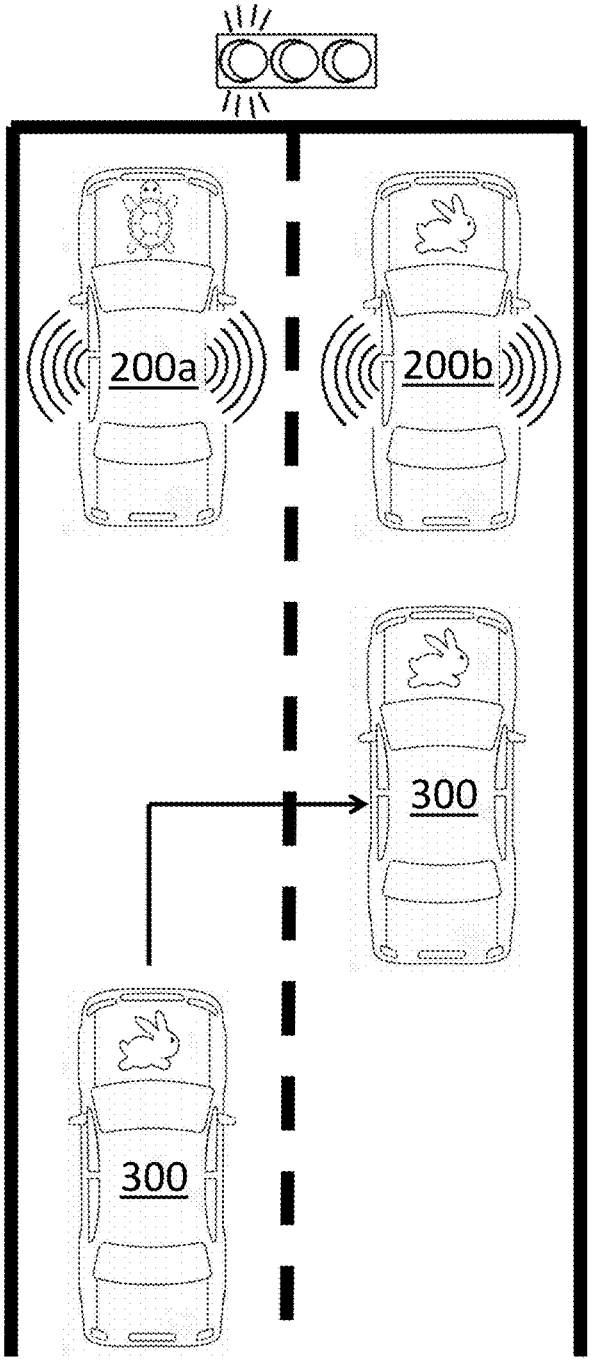

Referring next to FIGS. 8C and 8D, consider that piloted vehicle 200 is being piloted by a driver 210 (not shown) having a driving style largely characterized by passive or timid tendencies, and that occupant(s) 310 of nearby vehicle 300 prefer a driving experience characterized by short duration. Upon receiving driving style information concerning driver 210 of piloted vehicle 200, nearby vehicle 300 may take action in response to mitigate the chances of being stuck behind and delayed by piloted vehicle 200 in light of its driver's 210 passive driving style. In the example of FIG. 8C, vehicles 200, 300 are cruising, and in light of the potentially higher likelihood of being delayed posed by the presence of historically passive driver 210, vehicle 300 may opt to adjust its course to avoid vehicle 200 (e.g., move over and pass piloted vehicle 300). In the example of FIG. 8D, vehicles 200*a*, 200*b* are stopped at a stoplight next to one another, and vehicle 200*a* historically creeps out of stoplights while vehicle 200*b* historically accelerates at a faster rate of out stoplights. In light of the potentially lower likelihood of becoming stuck at a low rate of speed behind vehicle 200*b*, vehicle 300 may opt to adjust its course to avoid pulling up behind vehicle 200*a* (e.g., move over behind vehicle 200*b*. This may enhance the driving experience of occupant(s) 310 who prefer a trip with a short duration.

While the presently disclosed embodiments have been described with reference to certain embodiments thereof, it should be understood by those skilled in the art that various changes may be made and equivalents may be substituted without departing from the true spirit and scope of the presently disclosed embodiments. In addition, many modifications may be made to adapt to a particular situation, indication, material and composition of matter, process step or steps, without departing from the spirit and scope of the present presently disclosed embodiments. All such modifications are intended to be within the scope of the claims appended hereto.

What is claimed is:

1. A system comprising:

one or more cameras;

one or more sensors configured to collect current driving characteristics associated with operation of a vehicle by a human, the current driving characteristics comprising metrics recorded by the one or more sensors of the vehicle during a current trip;

a memory containing computer-readable instructions; and a processor configured to:

read the computer-readable instructions from the memory, record data representing an environment of the vehicle, the environment comprising a current environment recorded by the one or more cameras, record data representing the current driving characteristics for the current trip of the vehicle, determine that not enough data representing the current driving characteristics for the current trip has been collected and in response:

identify previous driving characteristics associated with the environment, the previous driving characteristics comprising data concerning how the human operates the vehicle during a previous trip, generate, based on the previous driving characteristics, a driving style of the human, the driving style of the human comprising a plurality of driving style categories with corresponding scale values, and transmit driving information including the driving style of the human to a nearby vehicle within a predefined distance, the nearby vehicle automatically adjusting current operations in response to receiving the driving information, and determine that enough data representing the current driving characteristics for the current trip has been collected after a period of time and in response:

generate a second driving style of the human using the data representing the current driving characteristics for the current trip, and transmit second driving information including the second driving style of the human to a second nearby vehicle within a second predefined distance, the second nearby vehicle automatically adjusting second current operations in response to receiving the second driving information.

2. The system of claim 1, wherein the driving information concerning the current driving characteristics includes identifiable metrics regarding how the human operates the vehicle including one or a combination of vehicle speed, vehicle acceleration, vehicle location, braking force, braking deceleration, vehicle speed relative to speed limit, vehicle speed in construction zones, vehicle speed in school zones, lane departures, relative speed to a vehicle driving ahead, relative distance to a vehicle driving ahead, and relative acceleration to a vehicle driving ahead.

3. The system of claim 1, wherein aspects of the driving style of the human include one or more patterns or tendencies derived from the driving information concerning the previous driving characteristics including one or a combination of rapid acceleration and braking, following within a predefined distance, dangerously changing lanes or changing lanes without signaling, drifting out of a traffic lane, exceeding a speed limit, driving under the speed limit, accelerating from stops slower than a predefined rate, braking within a predetermined time from a late braking threshold, a number, severity, and timing of traffic accidents, and a number, severity, and timing of traffic violations.

4. The system of claim 1, wherein the processor is located onboard the vehicle, and wherein the system further includes a transmitter for transmitting aspects of the driving style of the human to the nearby vehicle or to a remote server.

5. The system of claim 4, wherein the transmitter is configured to transmit the aspects of the driving style of the human to the remote server, and wherein the remote server is configured to transmit the aspects of the driving style of the human to the nearby vehicle.

6. The system of claim 1, wherein the processor is located on the nearby vehicle, and wherein the system further includes a transmitter on the vehicle for transmitting the driving information concerning the previous driving characteristics to the processor located on the nearby vehicle.

7. The system of claim 1, wherein the processor is located at a remote server, and wherein the system further includes a transmitter on the vehicle for transmitting the driving information concerning the previous and the current driving characteristics to the processor located at the remote server.

8. The system of claim 7, wherein the remote server is configured to transmit characterizing aspects of the driving style of the human to the nearby vehicle.

9. The system of claim 7, wherein the processor is further configured to automatically generate a warning communicable to the human operating the nearby vehicle based on a preferred driving experience of the human operating the nearby vehicle.

10. The system of claim 7, wherein the processor is further configured to automatically identify one or more options for adjusting an operation of a nearby autonomous vehicle based on a preferred driving experience of an occupant of the nearby autonomous vehicle.

11. A method comprising:

collecting current driving characteristics associated with operation of a vehicle by a human, the current driving characteristics comprising metrics recorded by sensors of the vehicle during a current trip;

recording data representing an environment of the vehicle, the environment comprising a current environment recorded by one or more cameras of the vehicle;

recording data representing the current driving characteristics for the current trip of the vehicle;

determining that not enough data representing the current driving characteristics for the current trip has been collected and in response:

identifying previous driving characteristics associated with the environment, the previous driving characteristics comprising data concerning how the human operates the vehicle during a previous trip;

generating, based on the previous driving characteristics, a driving style of the human, the driving style of the human comprising a plurality of driving style categories with corresponding scale values; and transmitting driving information including the driving style of the human to a nearby vehicle within a predefined distance, the nearby vehicle automatically adjusting current operations in response to receiving the driving information; and determining that enough data representing the current driving characteristics for the current trip has been collected after a period of time and in response:

generating a second driving style of the human using the data representing the current driving characteristics for the current rip, and transmitting second driving information including the second driving style of the human to a second nearby vehicle within a second predefined distance, the second nearby vehicle automatically adjusting second current operations in response to receiving the second driving information.

12. The method of claim 11, wherein the driving information concerning the driving characteristics is collected by one or more sensors onboard the vehicle.

13. The method of claim 11, wherein the driving information concerning the current driving characteristics includes identifiable metrics regarding how the human operates the vehicle including one or a combination of vehicle speed, vehicle acceleration, vehicle location, braking force, braking deceleration, vehicle speed relative to speed limit, vehicle speed in construction zones, vehicle speed in school zones, lane departures, relative speed to a vehicle driving ahead, relative distance to a vehicle driving ahead, and relative acceleration to a vehicle driving ahead.

14. The method of claim 11, wherein aspects of the driving style of the human include one or more patterns or tendencies derived from the driving information concerning the previous driving characteristics including one or a combination of rapid acceleration and braking, following within a predefined distance, dangerously changing lanes or changing lanes without signaling, drifting out of a traffic lane, exceeding a speed limit, driving under the speed limit, accelerating from stops slower than a predefined rate, braking within a predetermined time from a late braking threshold, a number, severity, and timing of traffic accidents, and a number, severity, and timing of traffic violations.

15. The method of claim 11, wherein evaluating and characterizing occur onboard the vehicle.

16. The method of claim 11, further including sharing, with the nearby vehicle or a remote server, the driving information concerning the driving characteristics associated with operation of the vehicle by the human, and evaluating and characterizing occur on the nearby vehicle.

17. The method of claim 11, further including sharing the aspects of the driving style of the human with a human driver of the nearby vehicle.

18. The method of claim 11, further including automatically generating a warning communicable to a human operating the nearby vehicle based on a preferred driving experience of the human operating the nearby vehicle.

19. The method of claim 11, further including automatically identifying one or more options for adjusting an operation of a nearby autonomous vehicle based on a preferred driving experience of an occupant of the nearby autonomous vehicle.

20. A non-transitory machine readable medium storing instructions that, when executed on a computing device, cause the computing device to perform a method comprising:

collecting current driving characteristics associated with operation of a vehicle by a human, the current driving characteristics comprising metrics recorded by sensors of the vehicle during a current trip;

recording data representing an environment of the vehicle, the environment comprising a current environment recorded by one or more cameras of the vehicle;

recording data representing the current driving characteristics for the current trip of the vehicle;

determining that not enough data representing the current driving characteristics for the current trip has been collected and in response:

generating, based on the previous driving characteristics, a driving style of the human, the driving style of the human comprising a plurality of driving style categories with corresponding scale values;

characterizing aspects of the driving style of the human based on one or more patterns and the previous driving characteristics, the aspects representing a predicted driving behavior of the human based on the environment; and transmitting driving information including the driving style of the human to a nearby vehicle within a predefined distance, the nearby vehicle automatically adjusting current operations in response to receiving the driving information; and determining that enough data representing the current driving characteristics for the current trip has been collected after a period of time and in response:

generating a second driving style of the human using the data representing the current driving characteristics for the current trip; and transmitting second driving information including the second driving style of the human to a second nearby vehicle within a second predefined distance, the second nearby vehicle automatically adjusting second current operations in response to receiving the second driving information.

* * * * *